US006913168B2

(12) United States Patent
Lawson et al.

(10) Patent No.: US 6,913,168 B2
(45) Date of Patent: Jul. 5, 2005

(54) TWIST LOCK VALVE FOR FLUID DISPENSING CARTRIDGES

(75) Inventors: Rebecca A. Lawson, Florence, SC (US); James W. Lowry, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 67 days.

(21) Appl. No.: 10/604,330

(22) Filed: Jul. 11, 2003

(65) Prior Publication Data

US 2005/0006407 A1 Jan. 13, 2005

(51) Int. Cl.[7] ..... B67D 5/34
(52) U.S. Cl. ..... 222/153.13; 347/86
(58) Field of Search ..... 347/86, 87; 137/843–860; 251/205, 208; 222/153.14, 387, 494, 549, 564, 153.13, 153.11

(56) References Cited

U.S. PATENT DOCUMENTS 5,027,986 A * 7/1991 Heinzel et al. ..... 222/402.24
5,851,079 A 12/1998 Horstman et al.
6,192,797 B1 * 2/2001 Rea et al. ..... 101/202
6,309,059 B1 10/2001 Ritter
6,419,351 B1 * 7/2002 Lawson et al. ..... 347/86
6,547,108 B2 4/2003 Johanson

* cited by examiner

*Primary Examiner*—Michael Mar
*Assistant Examiner*—Navneet S. Khaira
(74) *Attorney, Agent, or Firm*—Clausen Miller, P.C.

(57) ABSTRACT

A pressure-activated flexible valve for use with a container for dispensing fluid material such as ink. The valve has a single sealing surface and comprises a base portion having a valve seat and a cap having an annular rim that seats against the valve seat when the valve is closed. The cap has an annular flexible portion that changes shape in response to pressure from the container material, thereby opening and closing the valve. The valve may be locked closed, and the space between the valve rim and valve seat can be adjusted to accommodate a variety of fluids, including inks having different viscosities.

15 Claims, 5 Drawing Sheets

TWIST LOCK VALVE FOR FLUID DISPENSING CARTRIDGES

BACKGROUND OF INVENTION

This patent relates to a twist-lock valve for use with a fluid dispensing cartridge. More particularly, this patent relates to a lithographic printing press ink cartridge valve that can be adjusted to dispense inks of varying viscosities.

Modern ink cartridges for printing presses typically comprise a hollow tubular body, a moveable plunger inserted into one end, and a stationary dispensing fitment attached to the opposite end. The dispensing fitment covers the dispensing end of the tubular body and also serves as a valve for opening and closing the cartridge. Ink is extruded from the cartridge when the plunger is forced toward the dispensing end either manually or, more commonly, by pneumatic pressure.

The valve or dispensing fitment is mounted in sealing engagement within the dispensing (bottom) end of the tubular body. The valve serves four functions: (1) it controls the flow of ink from the cartridge when the plunger is activated; (2) it prevents the flow of ink at all other times, including during filling, transportation, storage, and installation of the cartridge on the printing press; (3) it prevents the introduction of air into the cartridge, which can cause localized ink drying at the nozzle and can effect the properties of the ink contents through oxidation or changes in viscosity; and (4) it prevents the flow of ink to other areas of the dispensing fitment or printing equipment. (Ink found in these areas can dry and flake off, contaminating the ink reservoir.)

Commonly owned U.S. Pat. No. 6,547,108, incorporated herein by reference, is directed to a pressure-activated flexible valve for an ink cartridge. The valve has a single sealing surface and comprises an inner component having a dish-shaped valve seat and an outer component having an annular rim that abuts the valve seat when the valve is closed. In a key aspect of the invention, the outer component also has an annular flexible portion configured to flex upward and outward when subjected to sufficient pressure from the container fluid material, thereby moving the annular rim between a closed position and an open position.

While this valve is suitable for its intended purpose, it cannot be used with all types of inks, including highly viscous ink. It can be difficult to extrude highly viscous inks through the relatively narrow annular opening between the valve rim and seat. The valve can also result in limited flow when used with a pneumatic hand-gun.

One possible solution to these problems is for the user to stock multiple cartridges for use in different applications and with inks of different viscosities. But this solution requires additional storage space and can result in increased printing costs.

What is needed is a single adjustable valve that is capable of dispensing a variety of inks under a variety of applications, including inks having different viscosities. The present invention fulfills this need.

It is an object of the present invention to provide a pressure-activated fluid dispensing valve that can be used with fluids of different viscosities.

Yet another object of the present invention is to provide a pressure-activated valve that can be set to a position that does not allow any flow of ink from the container.

Still another object of the present invention is to provide an ink cartridge that can dispense inks having very high and low viscosities.

Another object of the present invention is to provide an ink cartridge that works well with both automatic ink dispensing equipment hand dispensers.

Further and additional objects will appear from the description, accompanying drawings, and appended claims.

SUMMARY OF INVENTION

The present invention is a pressure-activated valve for use with a container for dispensing fluid materials of varying viscosities. The valve comprises a cup-shaped base and a twist cap mounted on the base. The base has a covering portion for covering an end of the container, a centrally disposed aperture, a neck extending axially downward from the periphery of the aperture, and a center element connected to an inner surface of the neck by bridges. The center element comprises a generally dish-shaped or elliptical-shaped valve seat, a sidewall extending upward from the periphery of the valve seat, and at least one locking pin extending radially outward from the center element sidewall.

The twist cap is rotatably mounted onto the neck and comprises a generally cylindrical sidewall and a flexible annular portion extending radially inward from the sidewall and terminating in a valve rim. The flexible portion is configured to flex downward when subjected to a predetermined amount of pressure from the container fluid material. The cap also comprises at least one cam pin extending upward from the flexible annular portion and having a groove therein adapted to engage a corresponding locking pin to prevent the flexible annular portion from flexing downward when the valve is in the LOCKED position.

Rotating the twist cap causes the cam pins to disengage from the locking pins, enabling the flexible annular portion to flex downward when subjected to a predetermined amount of pressure from the container fluid material to expose an annular opening between the rim and the dish-shaped valve seat through which fluid may flow.

The base further comprises a series of steps disposed around the center element sidewall. The steps are configured to provide for at least two discrete flow settings as the twist cap is rotated with respect to the base. The preferred embodiment has three flow settings, referred to herein as VALVE, STANDARD and HEAVY.

In the VALVE setting, the valve rim is seated against the dish-shaped valve seat but can be lowered in response to pressure from the contents of the container to dispense fluid. In the STANDARD setting, the rim is displaced downward a first discrete distance from the dish-shaped valve seat, exposing an annular opening there-between for dispensing a higher viscosity fluid. In the HEAVY setting, the rim is displaced downward a second discrete distance from the dish-shaped valve seat greater than the first discrete distance for dispensing an even higher viscosity fluid.

DETAILED DESCRIPTION

For purposes of illustration, the pressure-activated valve in the attached figures is shown as it might be used with a tubular paperboard ink cartridge for dispensing printing ink, although it will be understood that the valve may be used with other types of containers, including but not limited to metal containers, squeeze tubes and bags, and with other types of fluid materials, including gases, powders, emulsions and pastes. The ink cartridge is depicted with its valve (dispensing) end pointing down, as would be the case during use.

Figure 1:
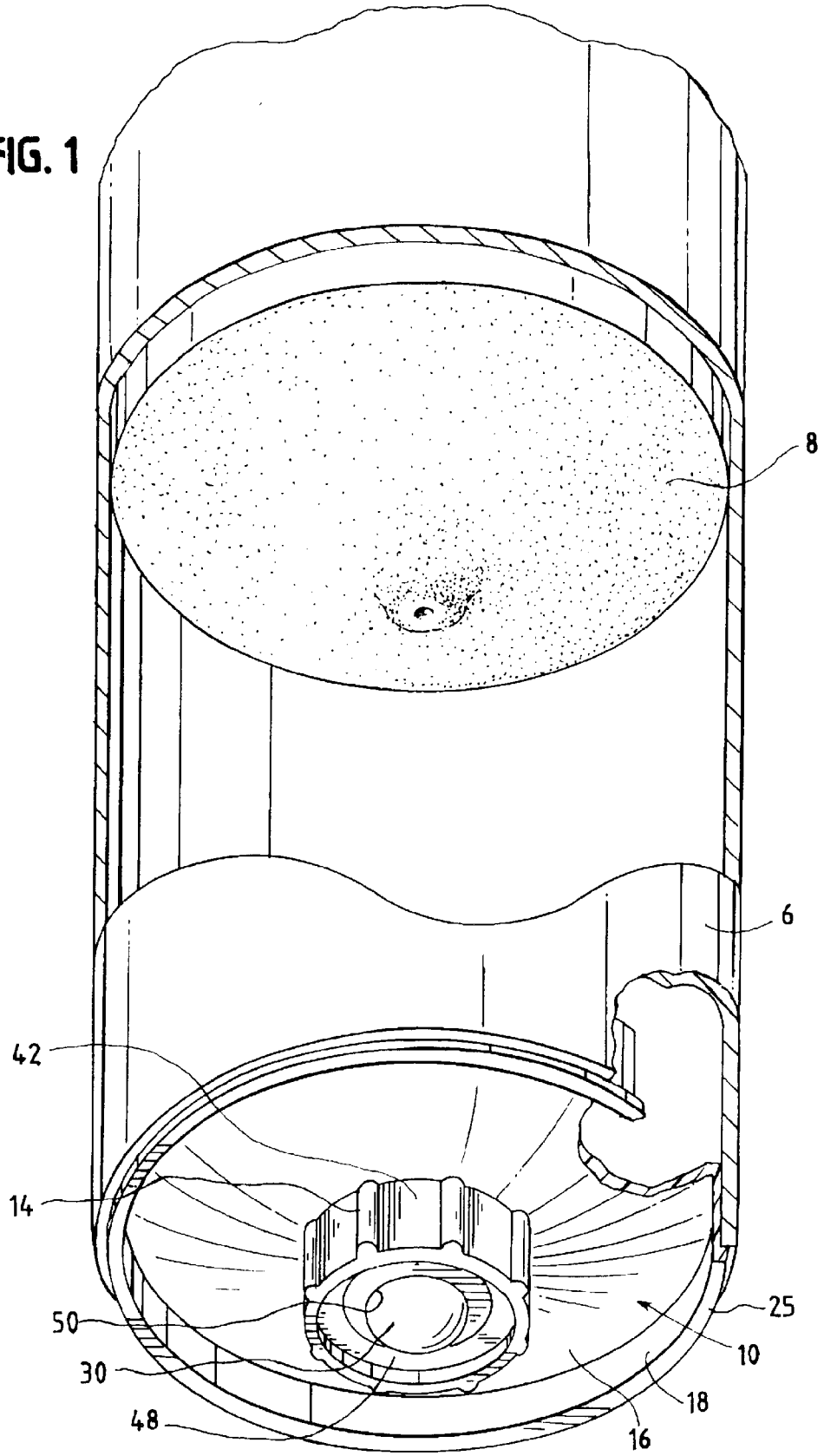
FIG. 1 is perspective view of an ink cartridge showing the twist-lock dispensing valve of the present invention, the cartridge shown in cutaway view to better show the plunger inside the cartridge.

FIG. 1 shows one embodiment of a twist lock dispensing valve 10 of the present invention as it might be installed in the dispensing end of an ink cartridge body 6. A plunger 8 is typically inserted into the opposite (upper) end and is configured to mate closely with the twist lock dispensing valve to minimize wasted ink. The operation of the twist lock dispensing valve 10 is explained below.

Figure 2:
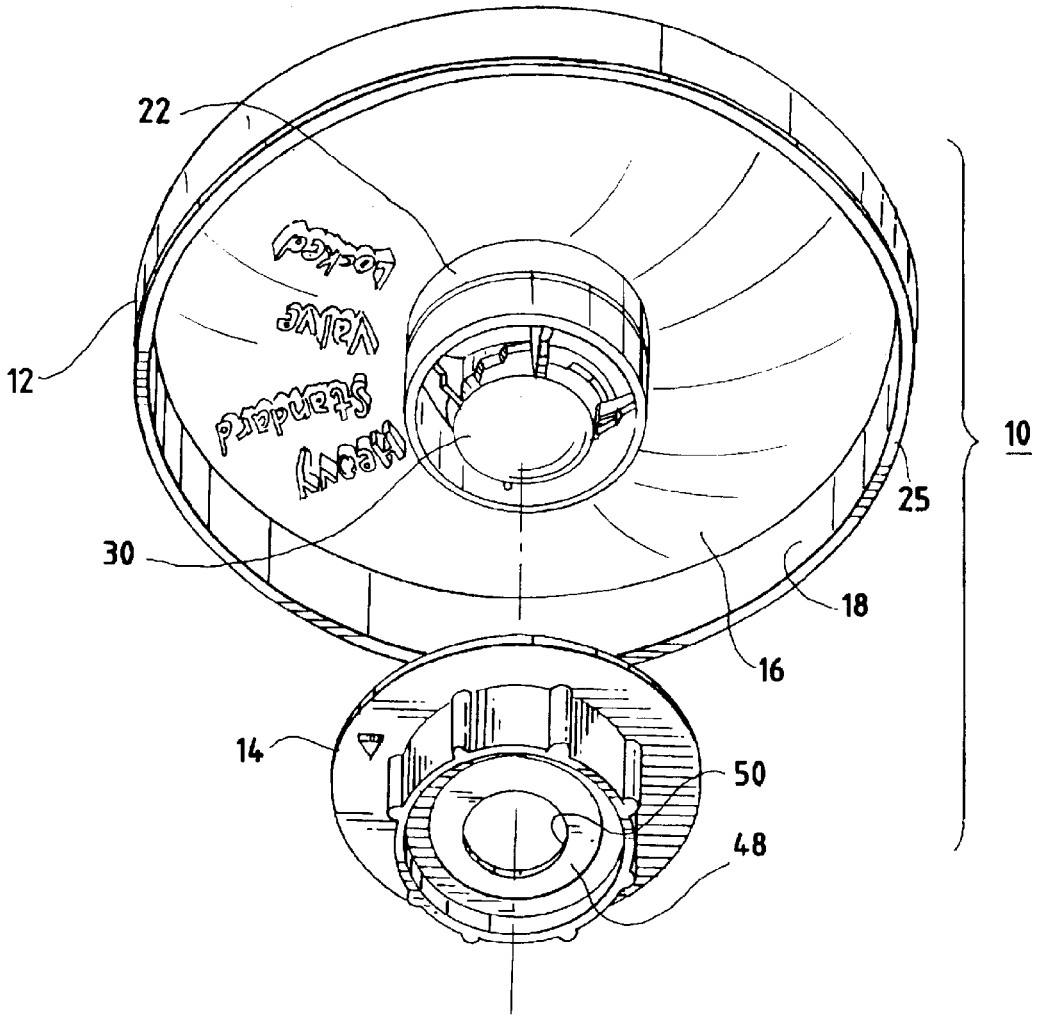
FIG. 2 is an exploded perspective view of the twist-lock dispensing valve of FIG. 1, showing the base and twist cap.
Figure 3:
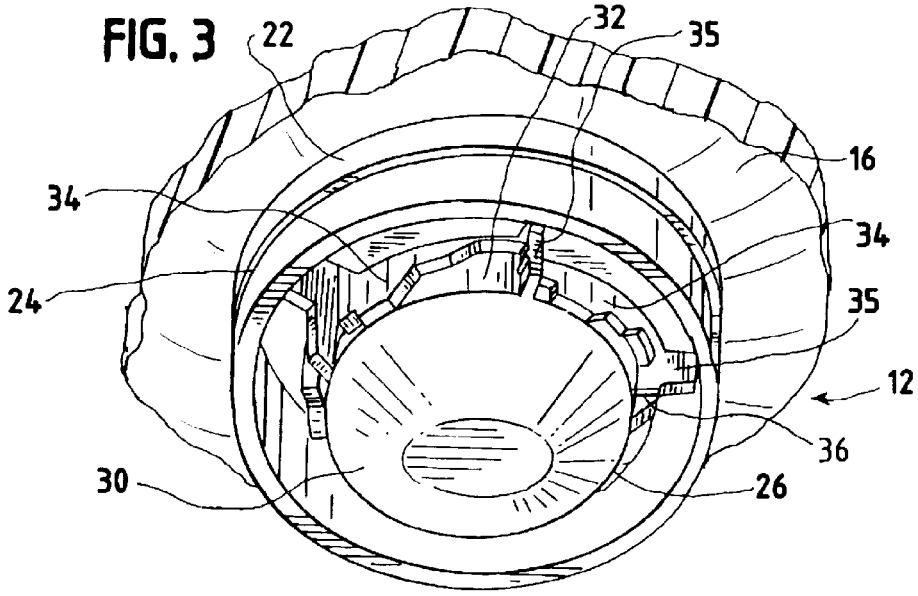
FIG. 3 is an enlarged perspective partial view of the twist-lock dispensing valve base of FIG. 2.

As best shown in FIG. 2, the twist lock dispensing valve 10 comprises a base 12 and a twist cap 14 mounted onto the base 12. The base 12 is generally cup-shaped and comprises a covering portion 16, a sidewall 18 extending downward from the periphery of the covering portion 16, a centrally disposed aperture 20 (FIG. 4), and a neck 22 extending downward from the periphery of the aperture 20. As best shown in FIG. 3, an annular groove 24 is located on the outer surface of the neck 22. The top side of the base 12 may be shaped to nest with the plunger 8.

The sidewall 18 fits snugly into the dispensing end of the cylindrical cartridge body 6 and may have a flange 25 that extends radially outward from the bottom edge of the sidewall 18 to abut the lower rim of the cartridge body 6 when the base 14 is fully inserted into the body 6 (FIG. 1). The sidewall 18 is affixed to the inner surface of the cartridge body 6. Alternatively, the sidewall can extend upward such a distance that it serves as the cartridge body, thereby eliminating the need for a separate cartridge body.

Figure 4:
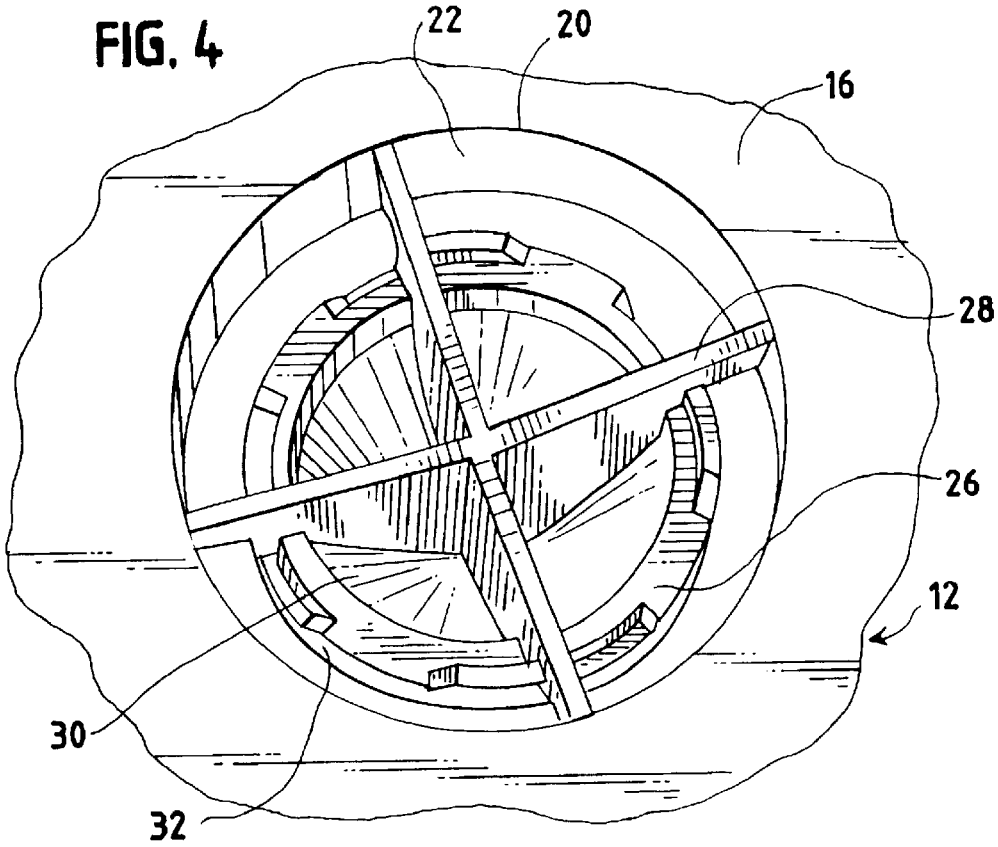
FIG. 4 is a top perspective view of the twist lock dispensing valve base of FIG. 2.

As perhaps best shown in FIGS. 3 and 4, the base 12 further comprises a center element 26 located within and attached to the neck 22 by ribs 28. In the preferred embodiment, the ribs 28 extend diametrically across the aperture 20 and form a cross to which the center element 26 is affixed.

The center element 26 comprises a valve seat 30 and an integral sidewall 32 extending upward from the periphery of the valve seat 30. The valve seat 30 is shaped somewhat like an inverted dome and may be dish-shaped or elliptical-shaped. One or more sets of steps 34 are disposed around and may be integrally formed with the sidewall 32. In the preferred embodiment, there are four identical sets of steps 34 arranged symmetrically around the sidewall 32 and separated by bosses 35 extending radially outward from the center element sidewall 32. As explained further below, these steps 34 control the size of the valve opening when the twist cap 14 is rotated, each step rise corresponding to a larger valve opening.

Figure 6:
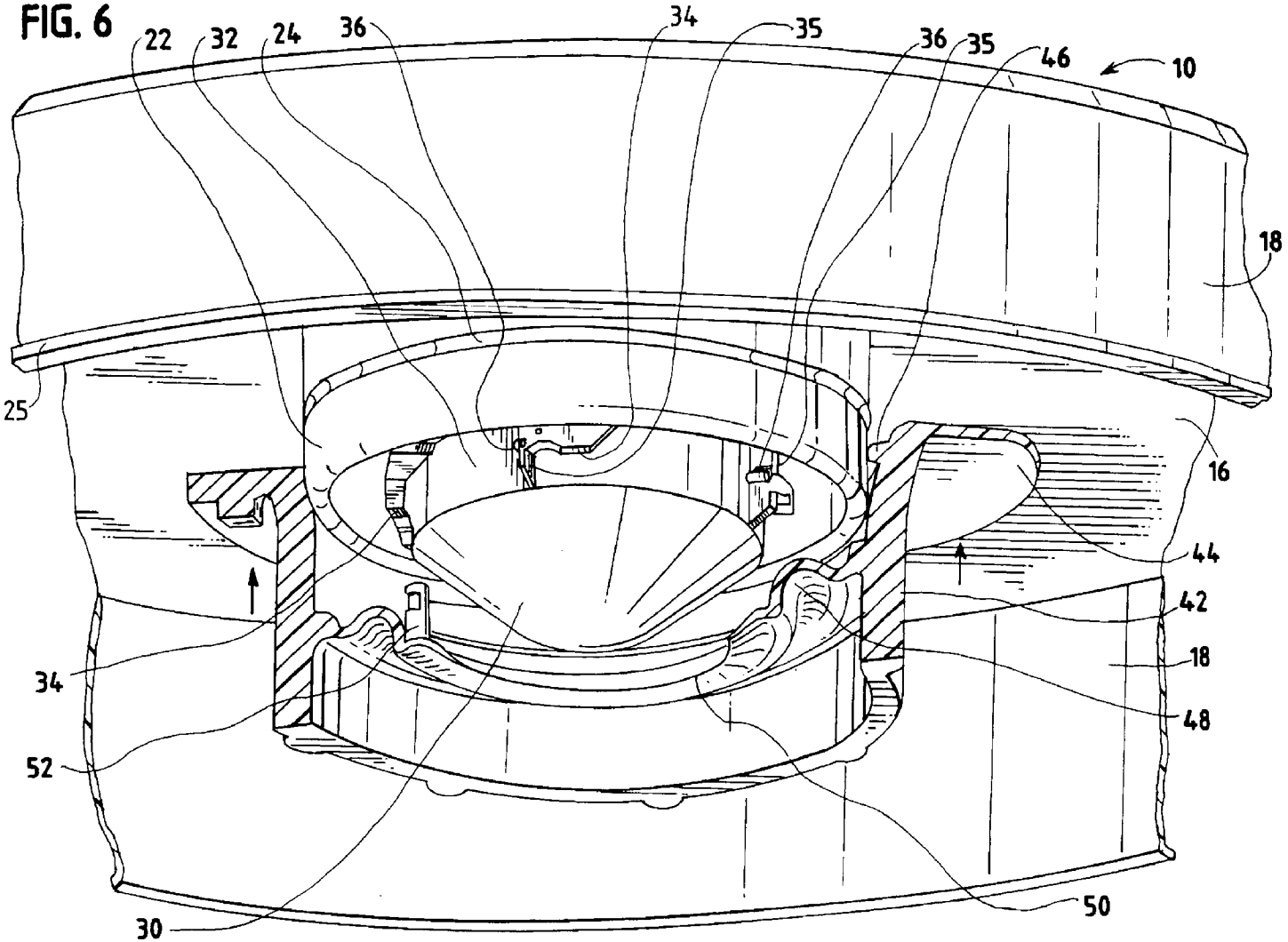
FIG. 6 is a perspective view of the twist lock dispensing valve of FIG. 1 with the twist cap partially removed from the base, showing a cross-sectional view of the twist-cap.

As best shown in FIG. 6, locking pins 36 extend radially outward from the center element sidewall 32 adjacent to the bosses 35 and below the first step 34. The function of these locking pins 36 is also described below.

Figure 5:
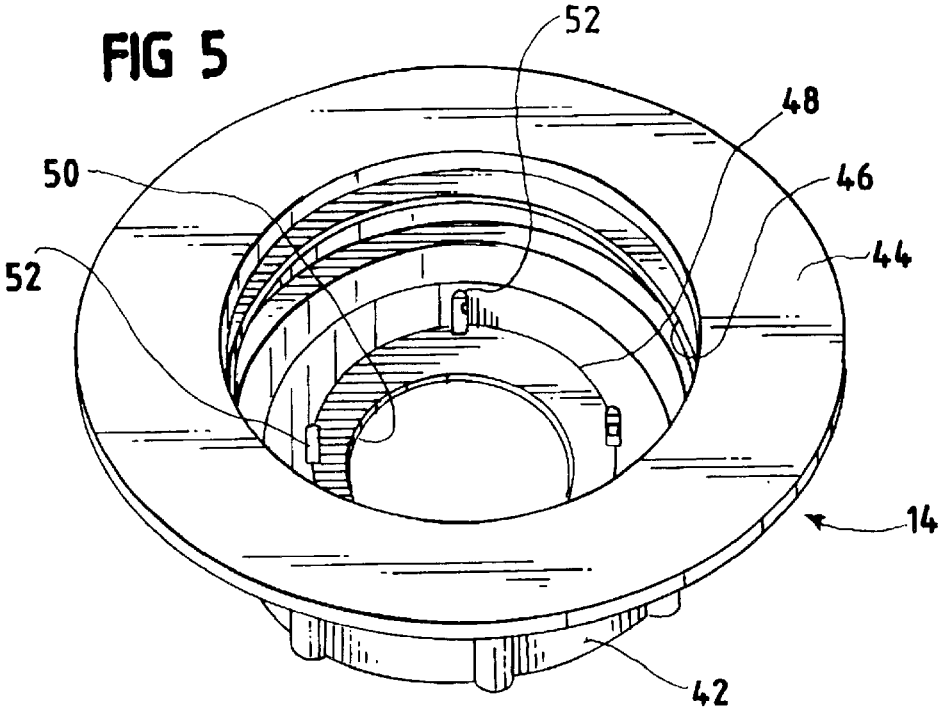
FIG. 5 is a top perspective view of the twist lock dispensing valve cap of FIG. 2.

Turning to FIGS. 5 and 6, the twist cap 14 comprises a sidewall 42, an annular flange 44 extending outward from the top of the sidewall 42, a rim 46 extending inward from the inside surface of the twist cap sidewall 42, and a flexible annular portion 48 extending radially inward from the sidewall 42. Hook-like cam followers 52 extend upward from the upper surface of the flexible annular ring 48. When the twist cap 14 is in the LOCKED position (see below), the cam-followers 52 on the twist cap 14 engage the locking pins 36 on the base 12 to prevent the valve 10 from opening.

Figure 8:
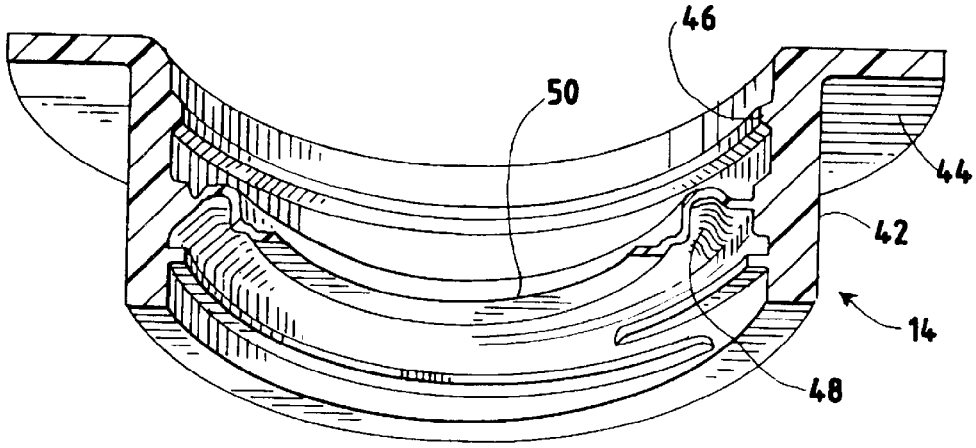
FIG. 8 is a cross-sectional perspective view of the twist lock dispensing valve cap of FIG. 7, taken along line 8—8.

As best shown in FIG. 8, the flexible annular portion 48 has a curved or wavy profile and terminates in a rigid annular rim 50 that defines a centrally located opening about ¾ inches in diameter. The twist cap 14 is rotatably mounted on the neck 22 of the base 12 by pushing the cap 14 onto the base 12 until the rim 46 is seated within the annular groove 24 (FIG. 6) located on the neck 22.

The twist-lock dispensing nozzle 10 has four settings, typically referred to as LOCKED, VALVE, STANDARD and HEAVY. As shown in FIG. 2, these settings may be embossed or otherwise marked on the base 12.

In the LOCKED position, the hook-like cam followers 52 are engaged by the locking pins 36 to prevent the valve from opening. In this position, fluid (eg., ink) cannot be dispensed from the cartridge, since the locking pins 36 prevent the flexible annular portion 48 from deflecting downward, regardless of whether pressure is being exerted on the flexible annular portion 48 by the cartridge contents.

When the twist cap 14 is rotated into the VALVE position, the cam followers 52 disengage from the locking pins 36. In this position, the twist-lock dispensing nozzle 10 functions substantially like the Sonoco Flow-Rite™ Exact valve described in U.S. Pat. No. 6,547,108. When there is little or no internal pressure exerted on the flexible annular portion 48 by the container contents, the valve rim 50 seats against the valve seat 30 to maintain the valve in the closed position, preventing the flow of ink. When sufficient pressure is exerted on the flexible portion 48 of the twist cap 14 by the contents of the cartridge, the flexible portion 48 will flex downward, exposing an annular opening between the valve rim 50 and the dish-shaped valve seat 30, thereby allowing the flow of ink out of the cartridge. When the internal cartridge pressure is sufficiently reduced, the flexible portion 48 returns to its original shape and the valve rim 50 is once again seated against the valve seat 30. The VALVE position is suitable for dispensing relatively low viscosity fluids.

When the twist cap (14) is further rotated to the STANDARD position, the cam followers 52 ride up the first of the steps 34, causing the flexible annular portion 48 to be displaced downward a set distance from the stationary dish-shaped valve seat 30 and exposing an annular opening there-between, even when the flexible portion 48 is in the relaxed (unflexed) position. This setting is suitable for most medium viscosity fluids.

When the twist cap 14 is rotated further to the HEAVY position, the cam followers 52 ride up the second of the steps 34, causing the flexible annular portion 48 to be displaced downward still further from the surface of the valve seat 30, thereby allowing for adequate flow of even high viscosity fluids.

The flexible annular portion 48 of the twist cap 14 has a geometry and thickness that enables it to flex under pressure.

In the twist cap 14 shown in FIG. 8, the flexible annular portion 48 has an S-shaped cross-sectional profile, although other shapes that allow flexing in response to changes in pressure exerted by the container contents will suffice.

When there is little or no internal pressure exerted by the container contents, the valve rim 50 seats against the valve seat 30 to close the ink cartridge and prevent the flow of ink. In the illustrated embodiment, the valve seat 30 is substantially dish-shaped, although any shape that provides a suitable sealing surface for the valve rim 50 will suffice.

The present invention features a single sealing surface that reduces the chance of leakage of material out of the container or the chance of air leaking back into the container. To insure a good, leak-proof seal between the opposing surfaces of the valve rim 50 and the valve seat 30 when the valve is in the VALVE position, the flexible annular portion 48 may be pre-stressed by the valve seat 30.

The plunger 8 is configured to mate closely with the dispensing valve base 12, thereby minimizing the amount of residual ink left in the cartridge after the plunge travels the full distance inside the container body 6.

Figure 7:
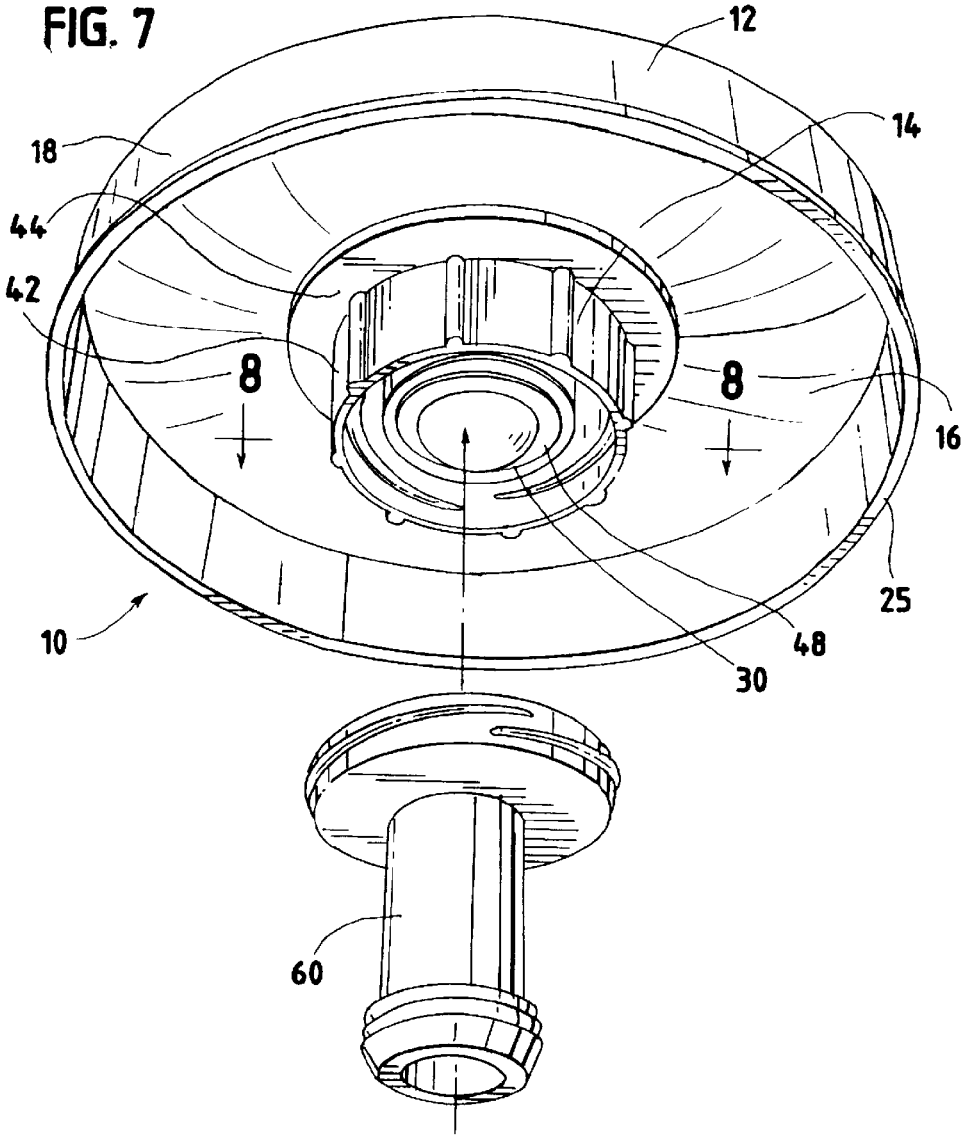
FIG. 7 is an exploded perspective view of the twist lock dispensing valve of FIG. 1 and an optional valve attachment.

As shown in FIG. 7, the twist lock dispensing valve 10 may be used with an optional nozzle extension 60, which can be threaded onto the valve cap 14. The nozzle extension helps direct the fluid flow. When removed, the cartridge assemblies can be stored with the valve end down since the valve cap 14 does not extend beyond the bottom edge of the valve base sidewall 18.

Thus there has been described a pressure-activated flexible valve having a single dynamic sealing area. The valve has multiple settings to accommodate different types of fluids, particularly fluids having different viscosities. The twist lock valve allows the same cartridge to be used with all types of inks and different equipment. The valve also solves the problem of limited flow from hand dispensers.

Other modifications and alternative embodiments of the invention are contemplated which do not depart from the scope of the invention as defined by the foregoing teachings and appended claims. It is intended that the claims cover all such modifications that fall within their scope.

What is claimed is:

1. A pressure-activated valve for use with a container for dispensing fluid materials, the valve comprising:

a base comprising a portion for covering an end of the container and a valve seat, the covering portion having an aperture;

a cap mounted to the base and comprising a sidewall, a flexible annular portion extending radially inward from the sidewall and terminating in a valve rim, the flexible portion being configured to flex downward when subjected to pressure from the container fluid material, and means for attaching the cap to the base such that the cap can be rotated with respect to the base; and means for retaining the flexible annular portion in an un-flexed position;

wherein rotating the cap causes the retaining means to disengage, enabling the flexible annular portion to flex downward when subjected to pressure from the container fluid material to expose an annular opening between the valve rim and the valve seat through which fluid may flow.

2. The valve of claim 1 wherein the retaining means comprises a locking pin affixed to the base and a cam pin extending upward from the flexible annular portion and adapted to engage the locking pin.

3. The valve of claim 2 wherein the base further comprises a neck portion defining a cylindrical space and extending axially downward from the periphery of the aperture and the valve seat is disposed within the cylindrical space and is affixed to the inner surface of the neck by bridges.

4. The valve of claim 3 wherein the valve seat has a perimeter and further comprises a sidewall extending upward from its perimeter, and the locking pin extends radially outward from the valve seat sidewall.

5. The valve of claim 4 further comprising a series of steps disposed around the valve seat sidewall and in engagement with the cam pin, wherein upon rotation of the cap the steps move the cam pin axially downward to create a gap between the valve rim and seat.

6. The valve of claim 5 wherein the steps are configured to provide at least two different sized gaps between the valve seat and rim as the cap is rotated.

7. The valve of claim 6 wherein the cap comprises multiple cam pins extending upward from the flexible annular portion and the base comprises multiple sets of steps arrange around the valve seat sidewall in engagement with the cam pins.

8. The valve of claim 1 wherein the valve seat is dish-shaped.

9. The valve of claim 1 wherein the base further comprises a sidewall extending downward from the periphery of the covering portion.

10. The valve of claim 1 wherein the base further comprises a flange extending radially outward from the bottom of the base sidewall.

11. The valve of claim 1 further comprising a nozzle extension adapted to fit onto the cap.

12. A pressure-activated valve for use with a container for dispensing fluid materials of varying viscosities, the valve comprising:

a base comprising a covering portion for covering an end of the container and having a centrally disposed aperture, a neck portion extending axially downward from the periphery of the aperture, and a center element connected to an inner surface of the neck by bridges, the center element comprising a valve seat, a sidewall extending upward from the periphery of the valve seat and a locking pin extending radially outward from the center element sidewall; and a cap rotatably mounted over the neck and comprising a sidewall, a flexible annular top portion extending radially inward from the sidewall and terminating in a rim, means for attaching the cap to the base such that the cap can be rotated with respect to the base, and a cam pin extending upward from the flexible annular portion and having a groove adapted to engage the locking pin to prevent the flexible annular portion from flexing downward;

wherein rotating the cap causes the cam pin to disengage from the locking pin, thereby enabling the flexible annular portion to flex downward when subjected to a predetermined amount of pressure from the container fluid material to expose an annular opening between the rim and the dish-shaped valve seat through which fluid may flow.

13. The pressure-activated valve of claim 12 wherein the center element further comprises steps disposed around the center element sidewall, the steps engaging the cam pin and configured to provide at least two discrete flow settings when the cap is rotated, including:

a first setting wherein the rim is seated on the dish-shaped valve seat but can be lowered in response to pressure from the contents of the container to dispense fluid; and a second setting wherein the rim is displaced downward a first discrete distance from the dish-shaped valve seat, exposing an annular opening there between for dispensing a higher viscosity fluid.

14. The pressure-activated valve of claim 13 wherein the steps are configured to provide a third discrete setting in which the rim is displaced downward a second discrete distance from the dish-shaped valve seat greater than the first discrete distance, for dispensing an even higher viscosity fluid.

15. The valve of claim 12 wherein the valve seat is dish-shaped.

* * * * *